US008216014B2

(12) United States Patent
Samelian

(10) Patent No.: US 8,216,014 B2
(45) Date of Patent: Jul. 10, 2012

(54) AMBIDEXTROUS RESCUE DEVICE

(76) Inventor: John K Samelian, Mendota Heights, MN (US)

( * ) Notice: Subject to any disclaimer, the term of this patent is extended or adjusted under 35 U.S.C. 154(b) by 188 days.

(21) Appl. No.: 12/658,538

(22) Filed: Feb. 10, 2010

(65) Prior Publication Data

US 2010/0216359 A1 Aug. 26, 2010

Related U.S. Application Data

(60) Provisional application No. 61/208,050, filed on Feb. 20, 2009.

(51) Int. Cl.
*B63C 9/08* (2006.01)

(52) U.S. Cl. ..... 441/81

(58) Field of Classification Search ..... 441/80, 441/81, 83, 84; 242/370, 404.1, 405, 405.2
See application file for complete search history.

(56) References Cited

U.S. PATENT DOCUMENTS

| | | | | |
|---|---|---|---|---|
| 2,342,868 | A * | 2/1944 | King | 441/81 |
| 4,862,636 | A * | 9/1989 | Doskocil et al. | 242/405.2 |
| 5,562,512 | A * | 10/1996 | Samelian | 441/81 |
| 5,895,299 | A * | 4/1999 | Hyde | 441/84 |
| 6,413,134 | B1 * | 7/2002 | Wahl et al. | 441/84 |
| 6,629,867 | B1 * | 10/2003 | Smith | 441/81 |
| 7,285,032 | B2 * | 10/2007 | Cha | 441/81 |
| 2002/0072286 | A1 * | 6/2002 | Smith | 441/80 |

* cited by examiner

*Primary Examiner* — Lars A Olson
(74) *Attorney, Agent, or Firm* — Jacobson & Johnson LLC

(57) ABSTRACT

An ambidextrous rescue device having a slip ring rotateable mounted with respect to the rescue device to permit the slip ring to rotate independently of the rescue device as the rescue device is thrown to thereby enhance the distance the rescue device can be thrown by reducing the spin that needs to be imparted to the rescue device during a throwing motion as well as reducing the tendency of the rescue device to spin out of a victims grasp once the rescue device is retrieved by pulling on the rope attached to the rescue device. A further advantage is that the device can be thrown by either a left hand thrower or a right hand thrower. In another embodiment the rescue device includes an arm girth to automatically cinch a person's extremity to the rescue device as the rescue device is pulled toward the rescuer.

19 Claims, 9 Drawing Sheets

AMBIDEXTROUS RESCUE DEVICE

CROSS REFERENCE TO RELATED APPLICATIONS

This application claims priority from provisional application titled Lockable or Nonlockable Rope Cavity Slip Ring or Rope Container, Integral to or Attached to Circular Thrown Rescue Floating Devices, and Rescue Rope Flying Devices Ser. No. 61/208,050 filed Feb. 20, 2009.

FIELD OF THE INVENTION

This invention relates generally to rescue devices and, more specifically, to improvement to hand thrown rescue devices.

STATEMENT REGARDING FEDERALLY SPONSORED RESEARCH OR DEVELOPMENT

None

REFERENCE TO A MICROFICHE APPENDIX

None

BACKGROUND OF THE INVENTION

U.S. Pat. Nos. 5,562,512 and 5,895,299 show rescue devices that contain a rope coil that is contained within an annular chamber of the rescue rings with one end of the rope fixed to the rescue ring. As the rescue device is thrown to a victim the rope coil unwinds from the rescue device, however, in some cases the rope may not completely unwind from the rescue ring. A problem may occur with such rescue devices is that after the victim being rescued grasps the rescue ring the rescue ring may be accidentally spun out of the victims hands as rescuer uncoils the remaining rope by pulling on the cord attached to the rescue ring. A further difficulty is that in some instance a victim may not have sufficient strength to hold onto the rescue device as the rescue device is pulled toward the rescuer due to exhaustion or hypothermia of the victim. In some cases the unwinding rope may induce drag that limits the distance the rescue device can be thrown and in other cases the rope on the rescue device may be wound for a left hand person and the person throwing the rescue device is right handed or vice versa.

SUMMARY OF THE INVENTION

An ambidextrous throwable rescue device in one embodiment having a slip ring rotateable mounted with respect to the rescue device to permit the slip ring to rotate independently of the rescue device as the rescue device is thrown to thereby enhance the distance the rescue device can be thrown by reducing the spin that needs to be imparted to the rescue device during a throwing motion and in another embodiment the throwable rescue device includes a cinch too grasp a persons extremity as the rescue device is pulled toward the rescuer. In still another embodiment the rescue device may includes a latch mechanism that can be engaged to prevent the slip ring from rotating.

DESCRIPTION OF THE PREFERRED EMBODIMENT

Figure 1:
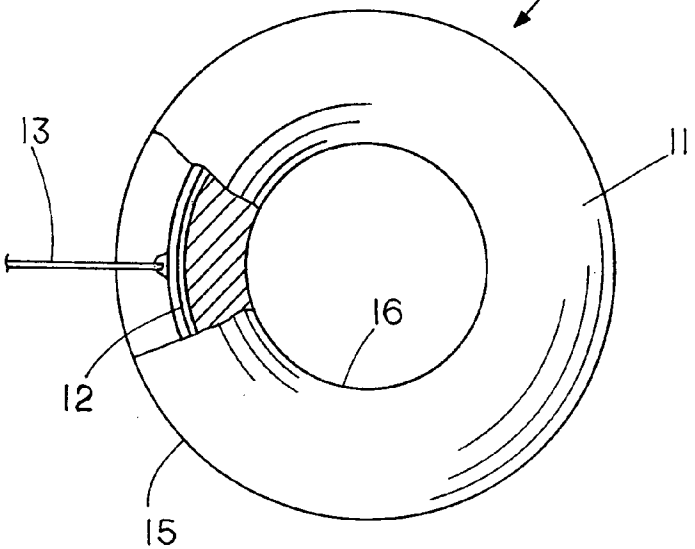
FIG. 1 is a cut away top view of my throwable rotateable rescue device with a slip ring.
Figure 2:
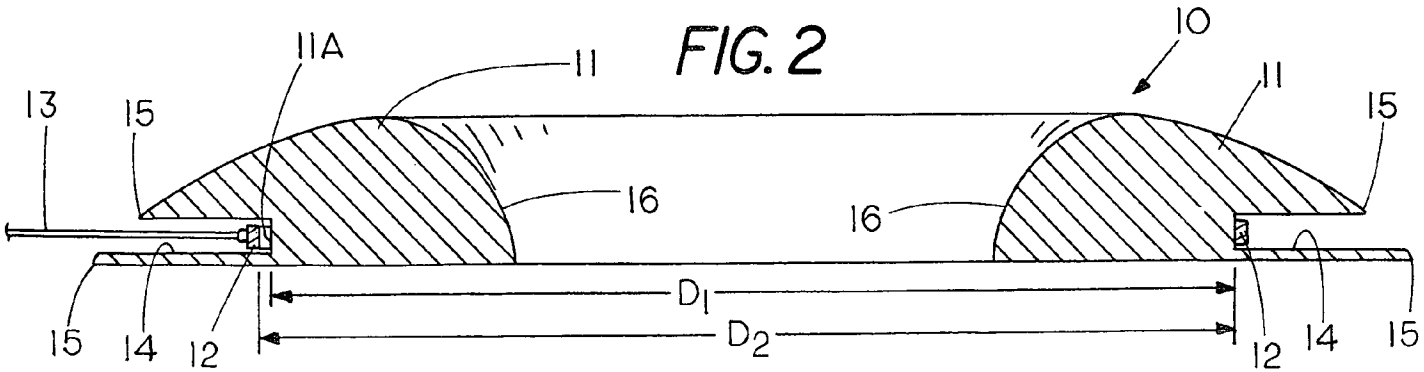
FIG. 2 is a cross sectional view of the rescue device taken along lines 2-2.

FIG. 1 is a top view of my ambidextrous throwable rescue device 10 that comprises an annular, rotateable member, which may also be referred to as a throwable rescue ring. FIG. 2 is a cross-sectional view revealing a concentrically positioned slip ring 12 that is rotateable mounted within an annular U-shaped slot or channel 14, which is located in the outer peripheral region of annular member 11. As shown in FIG. 2 the annular member 11 of rescue device 10 has a cross-sectional shape of a conventional airfoil or airplane wing whereby the air flow path from a central open region of the rescue device to an outer peripheral region, or vice versa, is longer on one side of the annular member than the other side of the annular member. What is conventional referred to as an airfoil trailing edge 15 is located on the outer portion of the rescue device and the what is conventional referred to as an airfoil leading edge 16 is located on the inner portion of the rescue device 10. Annular member 11 is a floatation ring which is preferably made of a lightweight rigid material such as closed cell polyurethane foam or other polymer plastics or combinations thereof to provide buoyancy and strength to the rescue device. For example, if the rescue device is thrown to a person in distress in a body of water, such as a lake, the rescue device 10 floats so that a person can grasp the rescue device 10 and be pulled to safety through cord 13. The rigidity of the material forming annular member 11 allows the rescue device to maintain its shape as it is thrown thereby enabling the rescue device to benefit from its aerodynamic shape both when it is thrown and when it is pulled through a body of water. Although the throwable rescue device 10 has been shown having the shape of a conventional airfoil, throwable rescue devices of other shapes, which may not have an aerodynamic shape can also benefit from the invention described herein as the invention described herein may be used in various throwable rescue devices without departing from the spirit and scope of the invention described herein. Cord 13 may take a variety of shapes and may for example include ropes, straps or other types of windable materials that have sufficient tensile strength to permit pulling a victim to safety on land or water.

Located in the outer and lower portion of throwable rescue device 10 is an annular U-shaped channel 14 for winding a rope therearound when the rescue device is not in use in order to keep the rescue device 10 in a throw-ready condition to enable the rescue device to be thrown toward a person who may need rescuing, for example, a person who has fallen into a lake or a person who falls through the ice on a pond or lake. In the example shown in FIG. 1 and FIG. 2 the rescue device 10, which is shown in cross section, is in the thrown or extended condition with the cord 13 unwound from the channel 14 to reveal the cord 13 having one end attached to a slip ring 12 concentrically positioned with respect to annular member 11. Slip ring 12 may take various forms, for example, slip ring may comprises a circular band or a rope or strap that has a diameter $D_2$ that is larger than the diameter $D_1$ of the annular rope support surface 11*a* so that the annular member 11 can rotate with respect to slip ring 12. That is the slip ring 12 may either be a rigid ring which has a larger diameter than the diameter $D_1$ of slip ring support surface 11*a*. Slip ring support surface 11*a* (as shown in FIG. 2) forms an annular bearing surface, which is located radially interior of annular member 11. Annular bearing surface 11*a* is characterized as having a surface free of obstructions that could prevent the slip ring 12 from freely rotating with respect to the annular bearing surface 11*a*. Alternately the slip ring 12 may be a flexible ring or loop formed from the rescue cord 13 or it may be a band or other material wherein the diameter $D_2$ of loop is sufficiently large in relation to the diameter $D_1$ of the slip ring support surface 11*a* so that the slip ring 12 can rotate independently of the annular member 11.

The circumferential rotation of the loop or slip ring 12 with respect to annular slip ring support surface 11*a* occurs as the cord 13 unwinds from the throwable rescue device when the throwable rotateable rescue device is thrown to a person in peril. In some cases the rate of rotation imparted to the throwable rotateable device 10 may lag the rate of rotation caused by the unwinding of the cord 13, which is a function of the straight-line velocity of the throwable rescue device. In such cases the unwinding of the cord, (i.e. the unwinding rate) from the annular member may limit the range of the throwable rescue device since energy must be imparted to increase the rate of rotation of the entire rescue device. In the examples shown herein the effect of a discrepancy in rotational rates between the annular member 11 and the slip ring 12 is minimized since both the annular member and the slip ring are free to rotate independently of each other. Thus energy which may be lost in the throwing of the throwable device 10 at a rotational rate different from the unwinding rate is minimized since any energy lost in increasing the rotation of the slip ring 12 due to unwinding of the cord is less than energy that would be lost in increasing the rotation of the entire throwable device 10 due to the unwinding of the cord.

Figure 3:
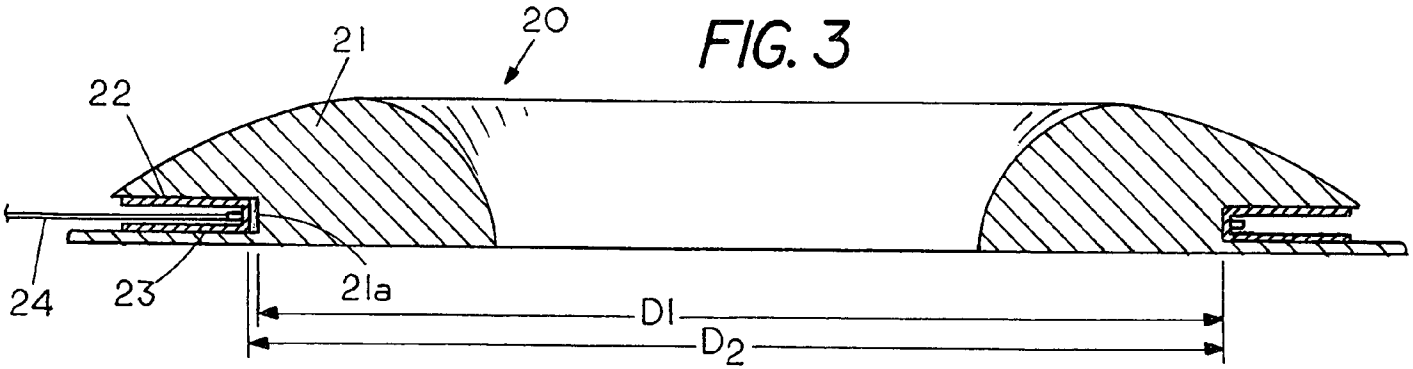
FIG. 3 is a cross sectional view of a rescue device with a rigid slip ring.
Figure 4:
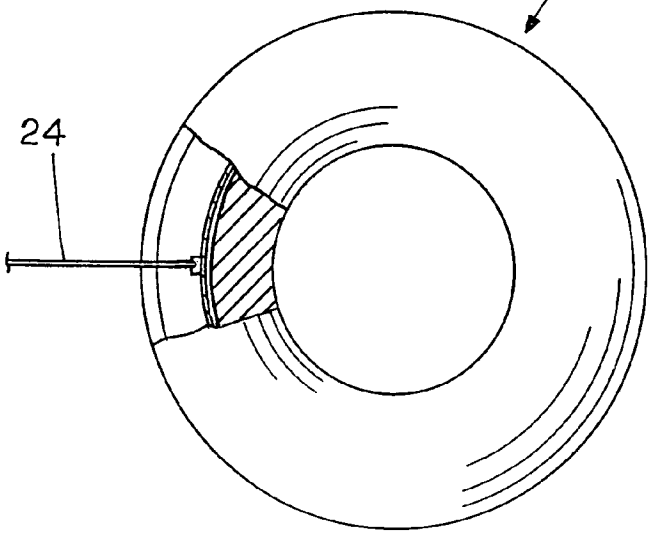
FIG. 4 is a cutaway top view of the rescue device of FIG. 3.

FIG. 3 and FIG. 4 show another example of a rescue device 20 having a U-shaped slip ring 23 that carries the cord thereon. Slip ring 23 is located in an annular U shaped slot 22 in the outer peripheral region of annular member 21. In the embodiment shown the slip ring 23 comprises a U shaped-member having a diameter $D_2$ which is larger than the diameter $D_1$ of the annular slip ring support surface 21*a*. Likewise the thickness $T_2$ of the U-shaped slip ring 23 is less than the width of the U shaped slot 22 so that the slip ring 23 is free to rotate independently of the annular member 21 as the rescue device 20 is thrown to a person in peril. In this example a flexible windable cord or rescue rope 24 can be carried in a coil in the U-shaped slip ring 23. By allowing the annular member 21 to rotate independently of the U-shaped slip ring 23 one may reduce the rope restraining force which allows the throwable rescue device 20 to be thrown further since the unwinding of the cord from the rescue ring is not dependant on the rotation imparted to the rescue device as it is thrown to a person in peril.

Once a victim grasps the rescue device the rescuer pulls on cord 24, which is secured to slip ring 23 to retrieve the victim. The slip ring 23 allows for straight line retrieval of the rescue device 20 and a victim grasping the rescue ring without the danger of the rescue ring being spun out of the hand of the victim as the remaining rope 24 is unwound from the slip ring. Thus, one of the benefit of the slip ring 23 is that it allows the rope to be unwound from a rescue device without spinning the rescue device from the victims hands as the rescuer pulls a victim toward shore, which may be significant if the victim is in a weakened condition. Another benefit of the slip ring is the ability of the slip ring to rotate independently of the rescue device to allow the rescue cord to unwind independently of the rotation of the rescue device thus lessen the restraining or drag forces on the rescue device which may limit the range that the rescue device can be thrown. A further benefit of the slip ring is that the slip ring responds equally for a right hand thrower or a left hand thrower. In general it is preferred that the rescue ring with a slip ring be wound in one direction for throwing with a right hand toss and in the opposite direction for throwing with a left hand toss. That is a right hand thrower may impart a clockwise rotation to the rescue device as it is thrown to a victim in peril while a left hand thrower may impart a counter clock wise direction to the rescue device as it is thrown to a victim in peril. Even though the rope, which is wound around the rescue ring, may have been wound for a right hand thrower the rescue ring with the slip ring describe herein has the advantage that it can still be tossed to a person in person by a left hand thrower. Thus the rescue device is an ambidextrous rescue device wherein a method of rescuing may include the step of winding the cord in either a clockwise or counterclockwise wise direction on the slip ring and the throwing of the rotateable rescue devices for either a left hand throw or a right hand throw.

Figure 5:
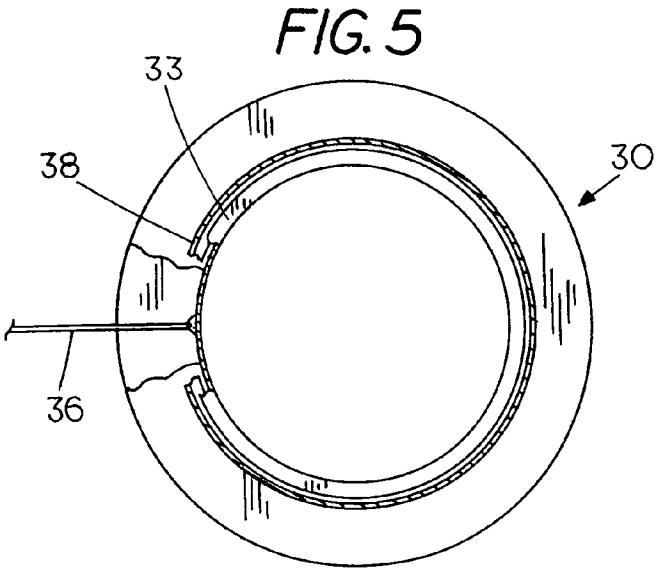
FIG. 5 is a cutaway top view of a rescue device with a slip reel secured to the underside of the slip ring.
Figure 6:
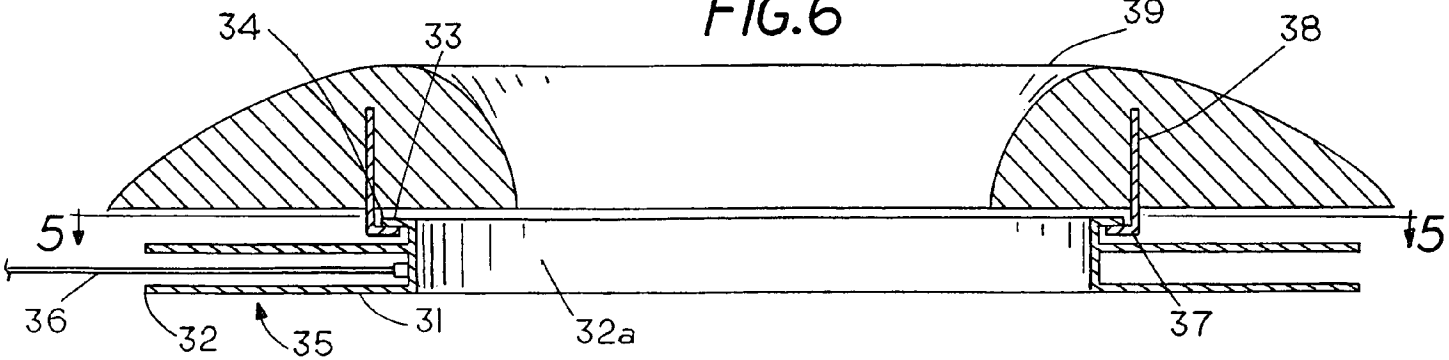
FIG. 6 is a cross sectional view of the rescue device of FIG. 5.

FIG. 5 and FIG. 6 show another example of a rescue device 30 with FIG. 5 taken along lines 5-5 of FIG. 6. Rescue device 30 includes a rope reel 35 located external to the annular member 39 with rope reel 35 including a slip ring 31 having a U shaped annular cord channel 32 and an inner annular member 32*a* that extends upward and then radially outward to form an annular lip 33 that slidingly engages an annular lip 33 that extends radially inward from member 38, which is fixedly supported by annular ring 39. In this example the annular lips 33 and 34 form slip surfaces to permit rope reel 35 to rotate independently of annular member 39. Thus the slip surfaces permit the cord 36 to unwind from the slip ring 31 independent of the rotation of annular member 39 since rope reel 35 can rotate independently of the rotation of the annular member 39. Thus it will be envisioned that the reel 35 can be externally secured outside of the annular member as a separate reel by attaching the reel to the underside of existing throwable rescue devices to enhance the effectiveness of such throwable rescue devices. In the example shown the reel 35 is rotateably mounted below the annular member 39, however, if desired the reel 35 may be mounted above the annular member 39.

Figure 6A:
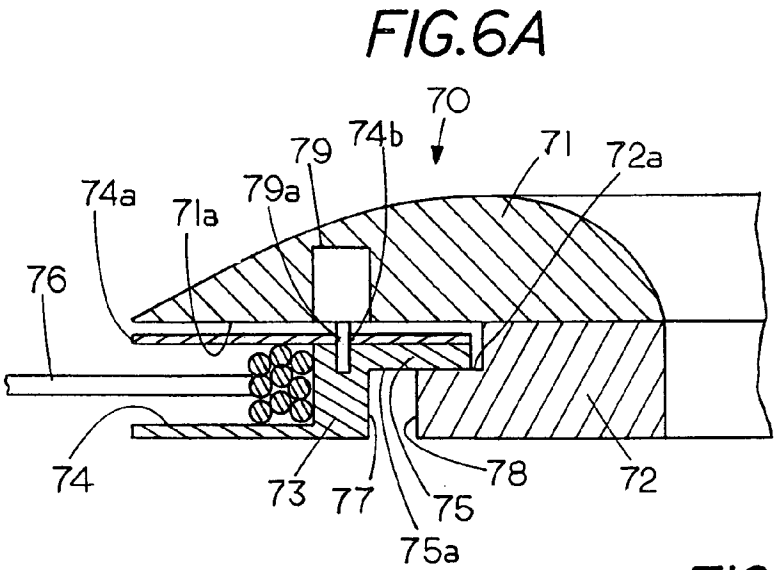
FIG. 6A is a cross sectional view of the rescue device revealing the rotateable reel thereon.

FIG. 6A shows a cross sectional view of another example of a rescue device 70 with a rotateable cord reel 73 mounted thereon. Rescue device 70 includes an upper annular flotation ring 71 and a lower annular flotation ring 72 secured thereto by an adhesive or mechanical fasteners. Ring 72 includes an outer annular surface 78 and a bearing surface 72*a*, which forms a gap between the underside 71*a* of ring 71 for positioning bearing surface 75*a* of reel 73 therein. Reel 73 includes a first annular outer lip 74 for laterally restraining a cord 76 therein and a second annular outer lip 74*a* for laterally restraining cord 76 in the opposite direction. In the example shown the upper lip 74*a* is separate annular member, however, if desired it could be integral and a one piece member. The reel 73 is positioned such that the annular reel surface 77 and the outer annular surface 78 are spaced from each other sufficiently far so that a thrower can insert his or her fingers into the annular recess therebetween in order to better grasp the rescue ring as it is tossed to a victim in peril. In operation of the rescue device pulling on cord 76 causes the reel 73 to rotate with respect to the rescue ring 70 since the low friction annular bearing surface 72*a* and low friction annular bearing surface 75*a* permit the reel 73 to rotate independent of the rescue device as the rescue device is thrown to a victim in peril. A feature of the embodiment of FIG. 6A is that it allows for a step by step assembly of the rescue device 70 to the reel 73 by sandwiching rear annular lip 75 on reel 73 between annular member 72 and annular member 71.

Figure 7:
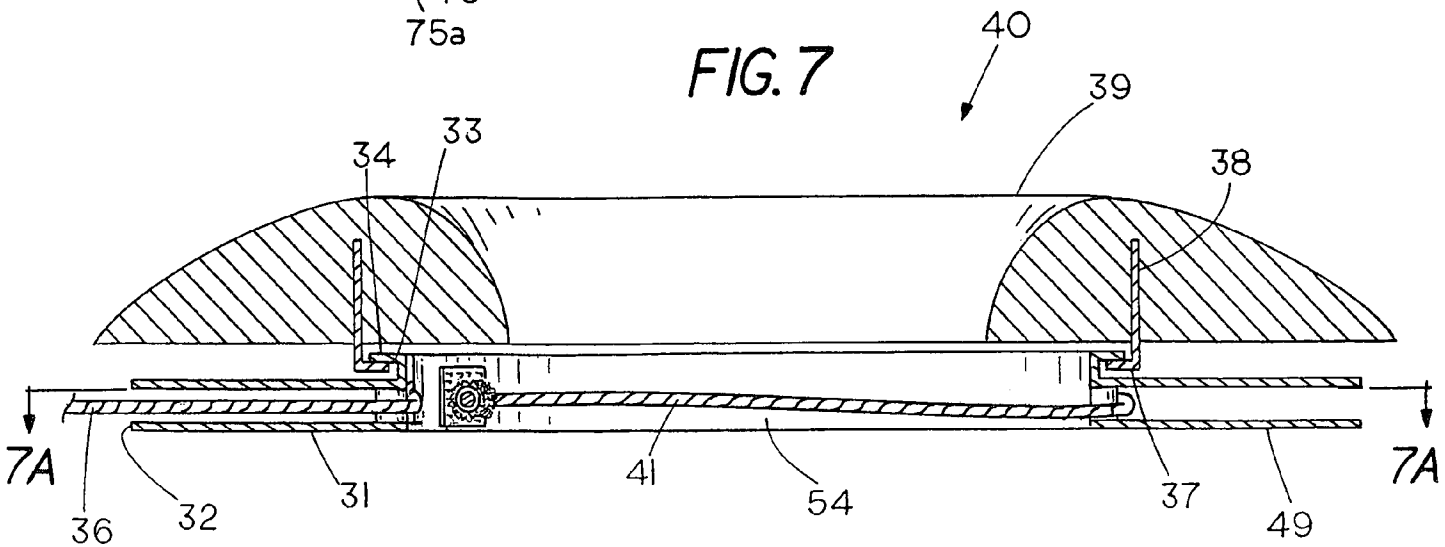
FIG. 7 is a cutaway view of a rescue device taken along lines 5-5 of FIG. 7 with a cinch in an open position for securing a person to the rescue device.

FIG. 7 shows a cross sectional view of a throwable rescue device 40 with a slip ring, which is similar to throwable rescue device 30 with like parts having identical numbers. Rescue device 40 differs in that rescue device includes an arm girth 41 which extends around the inner circumferential region 54 of the reel as the rescue device is thrown to a victim. A feature of the reel is that it allows the rope to be centered opposite from the person being rescued without spinning the rescue ring since the reel can spin independently of the annular flotation member. A feature of arm girth 41, when used with a reel, is that it allows one to automatically secure a persons arm to the rescue device 40 directly in line with the direction of pull on the cord as the rescue ring is retrieved thereby lessening the chances that the person may be pulled free of the rescue device or wrapped about the cord as the rescue device is retrieved.

Figure 7A:
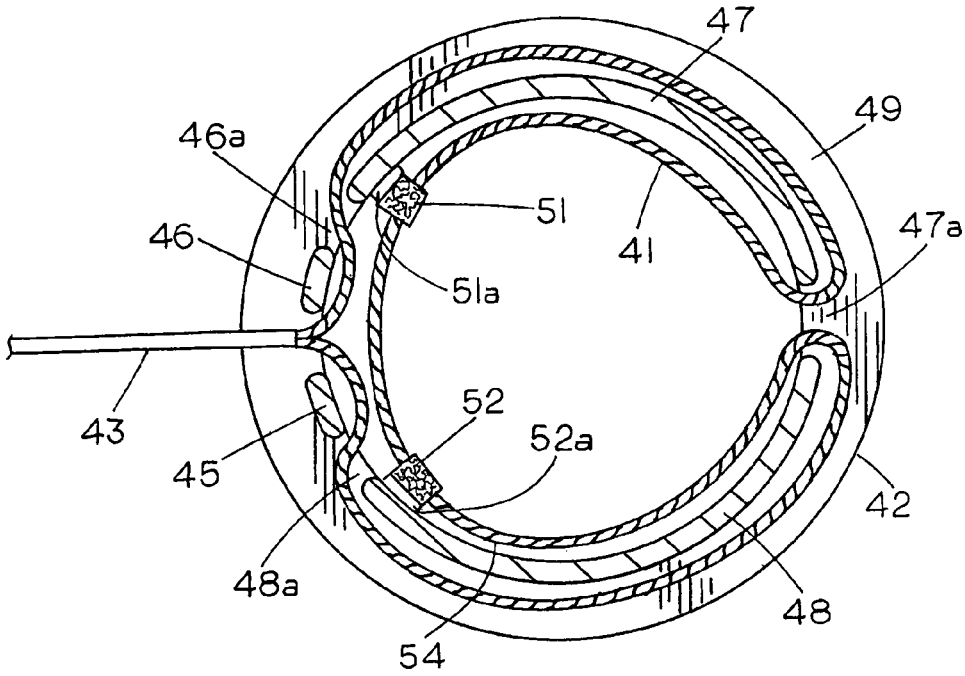
FIG. 7A is a cross sectional view taken along lines 7A-7A of FIG. 7 to shows the rescue device in a cinching action.
Figure 12:
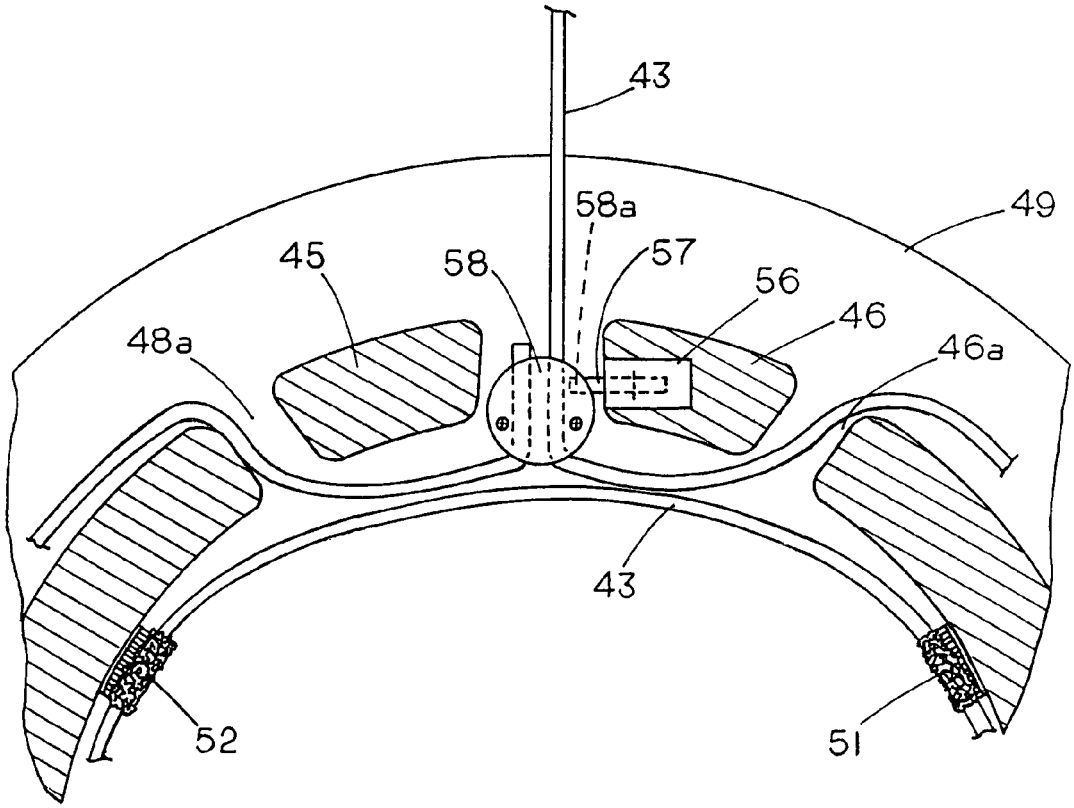
FIG. 12 is a partial sectional view showing the radio controlled latch mechanism for the arm girth.

FIG. 7A which is taken along lines 7A-7A of FIG. 7 shows the arm girth 41 located as a loop on the end of cord 43 with the arm girth 41 located on the interior circumferential region 54 of the reel 41, FIG. 7 shows the girth 41 loops past member 46 and through an opening 46*a* and extends radially outward behind member 47 and then is directed through opening 47*a* and around the interior circumferential region of slip ring 49 and back through opening 47*a* and radially outward behind member 48, through opening 48*a* and in front of member 45 where it joins to cord 43. The portion of the rope located on the interior portion of slip ring 50 is held in place by arm girth retainers 51 and 51*a* and 52 and 52*a* which may comprises for example removal fasteners such as Velcro fasteners. The purpose of the fasteners is to hold rope 43 in the open position and out of the way on the inner circumferential region 54, as shown in FIG. 7A, during the throwing phase of the rescue ring 40. Other fasteners may be used to temporarily hold the rope on the inner portion of slip ring 49, for example, clips or members that frictionally engage the rope may be used as long as the pulling force on the rope is sufficient to release the arm girth 41 from the retainers. That is a frictional fastener such as a hook and loop fastener can be set to allow the pulling force on the rope cause the fasteners to open and release the rope forming the arm girth from around the interior of the rescue ring. If desired radio controlled latches may also be used to release the arm girth from the rescue ring thus giving a user the option of using or not using the cinching arm girth during a mission. The use of a radio controlled remote such as a radio controlled solenoid to release the girth allows for on-the-go activation of the girth which has the benefit of allowing the rescuer to decide if the victims arm is in the correct position for initiating the cinching process. That is, the use of a radio controlled latch allows the person to decide on-the-go whether to use the arm girth or not in the rescue attempt. In other cases the person may be close to the rescuer or floating away from the rescuer. For example, when the victim appears strong enough to hold on to the rescue device and is close to the rescuer the arm girth may not be needed. In other case the victims arm may not be properly positioned on the rescue device, for example, the victim's arm may not be through the ring and may be holding on to the rescue device by only his or her fingers. A suitable fastener may include an extendible and retractable pin that is controlled by a radio activated solenoid. With the pin in the extended condition the arm girth would remain in position on the ring but with the pin in the retracted condition the arm girth would be released to cinch a person to the rescue ring. An example of a radio activated latch mechanism is shown in FIG. 12 wherein a retractable pin 57 can be operated by a radio controlled solenoid 56. In the extended position pin 57 engages a recess 58*a* in ball latch 58 which is secured to rope 43 to prevent the arm girth from being cinched about a victim in peril. With pin 57 in the retracted position (not shown) the rope 43 and ball clamp 58 can be pulled toward the rescuer allowing the rope 43 forming the arm girth to be cinched about a user's extremity. While a ball clamp is shown it is envisioned that other types of devices for holding the rope 43 to prevent release of the arm girth are within the spirit and scope of this invention.

The slip ring latch mechanism can also be controlled by a radio activated solenoid as illustrate in FIG. 6A which shows a latch mechanism including a radio activated solenoid 79 having a retractable and extendible pin 79*a* for engaging an opening 74*b* in reel 73 to prevent rotation of the slip ring with respect to the annular member 71. For example, in some the victim being rescued may be close to the rescuer and it is desired to not wait while all the rope unwinds from the rescue device before pulling the victim to safety. By remotely activating the latch mechanism to extend the pin 79*a* into engagement with reel 73 a victim can be immediately pulled toward the rescuer since one does not have to wait for all of the rope to unwind from reel 73.

If desired both the slip ring and the arm girth can be controlled by a radio activated solenoids or alternately one or both may be manually set before the rescue device is thrown to a victim in peril.

In any event by holding the arm girth 41 in the open position as shown in FIG. 7A a victim will simultaneously extend his or her hand arm other body extremity through the opening in the rescue device and through the arm girth 41 as the victim grasps the annular member rescue device. If a latching mechanism with a radio control is used the rescuer can decide on-the-go as whether to use the cinching feature of the arm girth or not use the cinching feature of the arm girth.

While the cord described herein may be any type of flexible member such as rope, straps line or other materials that has sufficient strength to permit pulling a person to shore and light weight so as not to unduly limit the range that the rescue ring may be thrown. If desired the cord may be made of flotation material so as to remain in a floating condition as the cord is cinched about a person's arm.

Figure 7B:
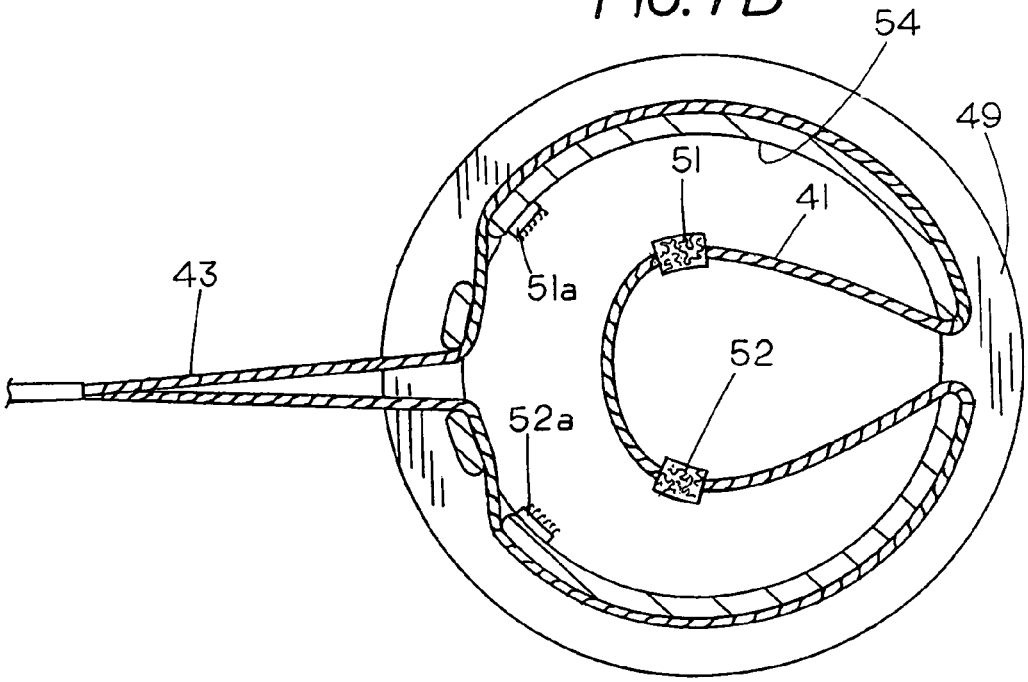
FIG. 7B is a cross sectional view taken along lines 7A-7A of FIG. 7 to show the rescue device in a cinching action.
Figure 7C:
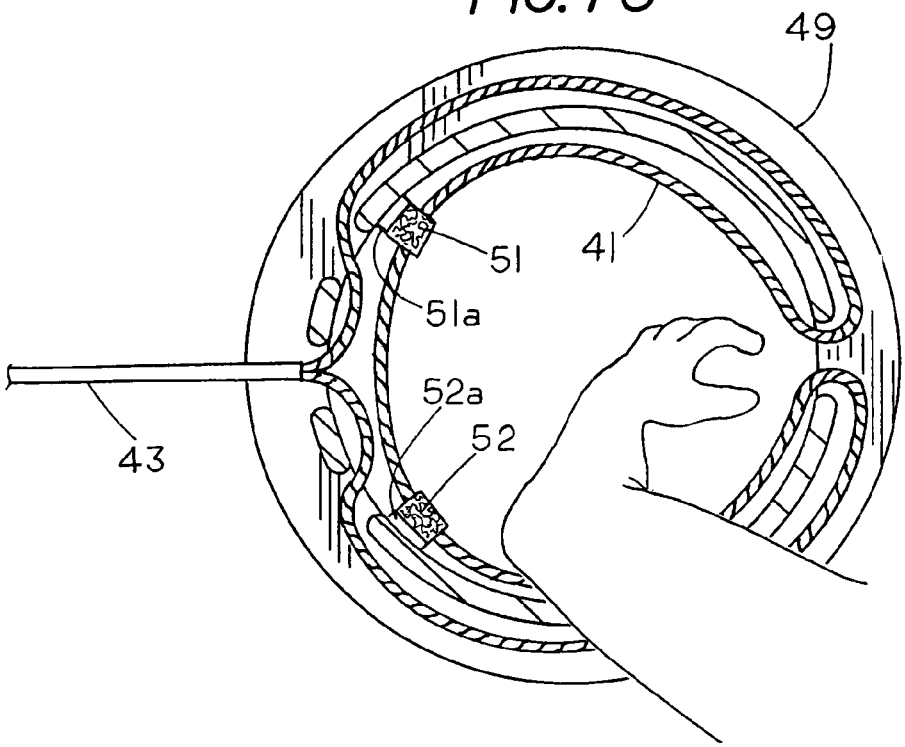
FIG. 7C is a cross sectional view taken along lines 7A-7A of FIG. 7 to show the rescue device in a cinching action about an extremity of a person.

FIG. 7B illustrates the cinching action of the arm girth 41 as the arm girth 41 pulls free from supports on slip ring 49. To illustrate how the arm girth 41 operates reference to FIG. 7C shows an arm extending through the slip ring 49. As a pulling force is applied on rope 43 the rope loop 43 forming the arm girth 41 automatically collapses to form a smaller rope loop. While rope 43 is shown for forming the arm girth 41 in some cases one may want to form the arm girth from a separate material. For example, instead of using a portion of rope 43 for the arm girth 41 a flexible web or strap may be attached to rope 43 at ball clamp 58 to provide an arm girth having a wider contact area. The purpose of the wider contact area is to lessen the trauma on a person's extremity as the person is being pulled to safety since a broad or wider strap will distribute the pulling forces over a wider area as the arm girth is cinched about a person's extremity. Thus a flexible web or strap may be used as the arm girth to provide a more gentle but secure grasp of the victim.

Figure 7D:
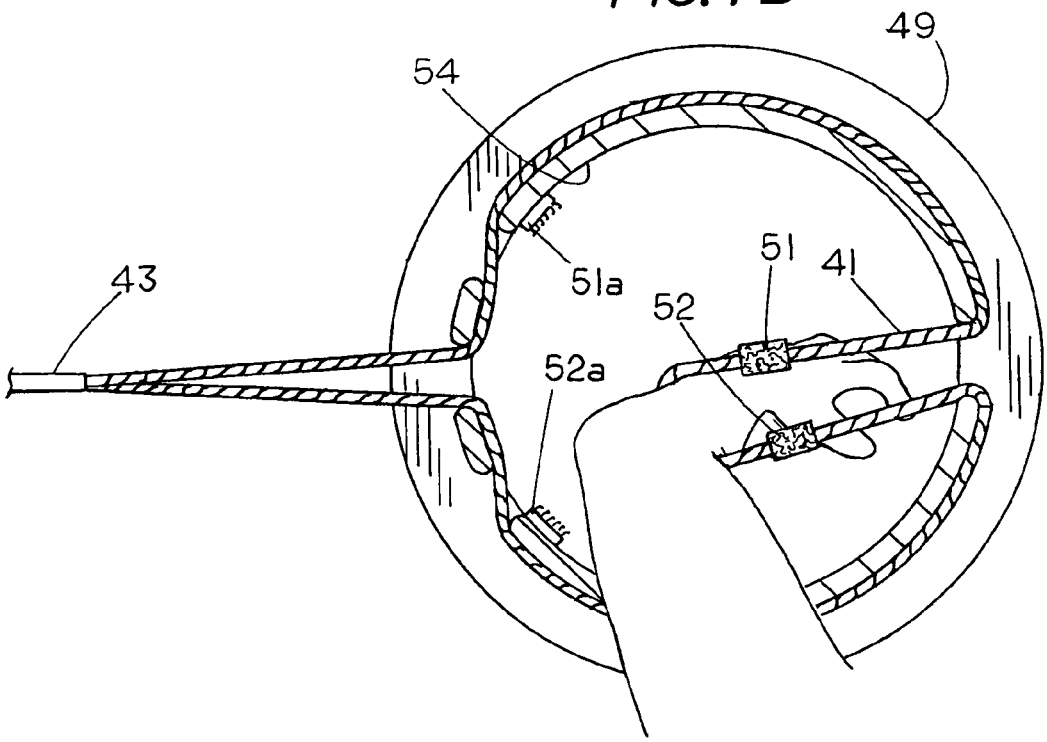
FIG. 7D is a cross sectional view taken along lines 7A-7A of FIG. 7 to show the rescue device cinch about an extremity of a person.

While FIG. 7C illustrates a victim having his or her arm extending into the central opening in a rescue ring attached to slip ring 49 FIG. 7D shows how the arm girth 41 has decreased in size and is cinching the arm of a victim to the slip ring 49 and hence to the rotateable rescue device 40. Thus as part of the method of rescue where a slip ring such as a reel is used the rescue process may include the step of cinching an arm girth about an extremity of a person by pulling on the rescue device to center the rope on the rescue device so that the direction of pull on the rope is diagonally opposite of the person which minimizing the tendency to spin the ring out of the victims hands.

Figure 8:
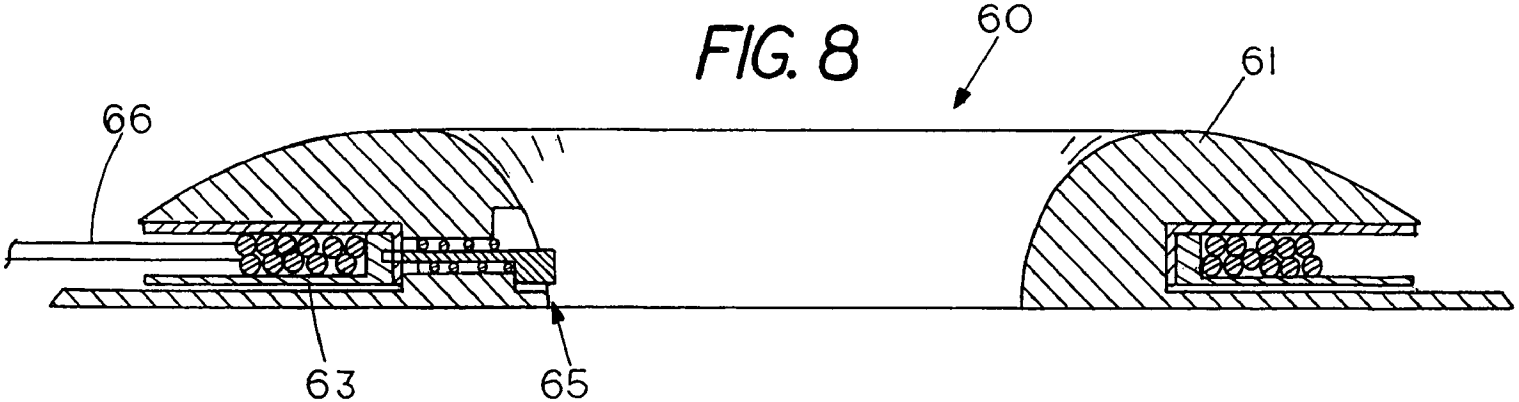
FIG. 8 is a cross sectional view of a rotateable rescue device that includes a slip ring latchable in either a rotational or non rotational condition.

FIG. 8 shows a cross sectional view of another example of a throwable rescue device or rescue ring 60 wherein the U shaped slip ring 63 includes a latch 65 to prevent the slip ring 63 from rotating independently of the annular member 61. This feature enables the thrower to select whether the slip ring 63 can slip or not slip based on the discretion of the thrower. As can be seen in FIG. 8 a portion of the coil of unwound rope is located in slip ring 63. Normally, pulling on rope 66 causes the slip ring 63 to rotate with respect to annular member 61 until the rope was unwound from the slip ring 63. However, to deactivate the slip ring 61 the annular member 61 includes a latch 65 that can be engaged to the slip ring 63 to rotationally affix the annular member 61 to slip ring 63 and prevent independent rotation of the slip ring 63 with respect to the annular member 61. In this example, a spring-loaded pin 67, which is shown in the retracted condition in FIG. 8 and FIG. 8A, allows annular member 63 to rotate independent of slip ring 63. In some instance one may include a radio controlled latching and unlatching mechanism for either the reel or the cinch so the latching can occur on-the-go. A radio controlled latching and unlatching mechanism may be useful when used with the arm girth 41 to allow the arm girth to be released in order to grasp a users extremity or the latch can be maintained in a latched condition to allow the rescue device to be used in a conventional manner.

Figure 8B:
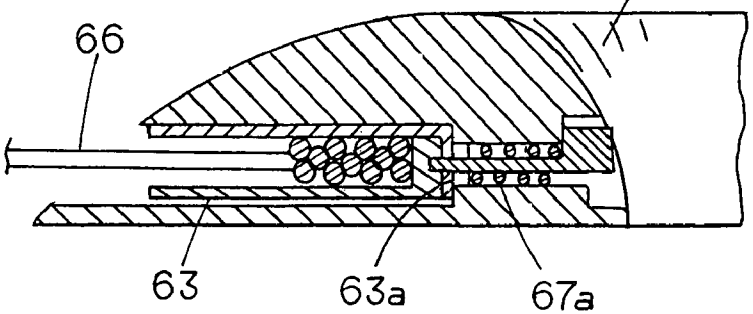
FIG. 8B is a cross sectional view of a rotateable rescue device that includes a slip ring latched in a non-rotational condition.
Figure 8A:
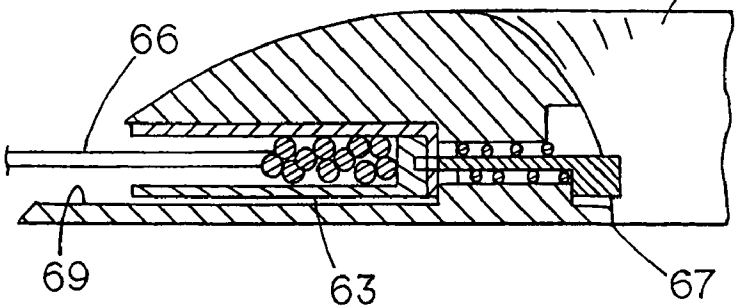
FIG. 8A is a cross sectional view of a rotateable rescue device that includes a slip ring la rotational condition.

FIG. 8B shows the spring loaded pin 67 in the extended position with pin 67 engaging an opening 63*a* in slip ring 63 to prevent rotation of slip ring 63 with respect to annular member 61. Thus in this example, the thrower can select whether or not to use the slip ring by moving latch pin 67 from the unlocked or unlatched position shown in FIG. 8A to the locked or latched position shown in FIG. 8B depending on the use of the rescue device. For example, if the rescue device 60 is thrown to a boat in distress and the person on the boat wants to keep the boat from drifting and does not want to wait for the rope to be uncoiled and one would want the rescue device in a latched condition. Similarly, when in the process of docking a boat the rescue device may be thrown to a dockhand and it is desired that rope remains coiled so the boat can be quickly pulled to the dock. In these cases the rescue device can be locked in the nonslip condition as shown in FIG. 8B.

Figure 9:
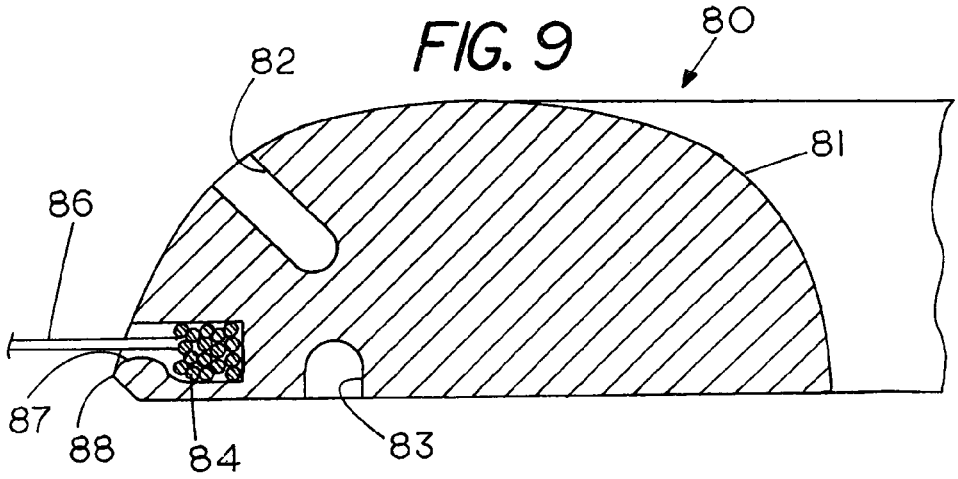
FIG. 9 is a cross sectional view of a rotateable rescue device that includes a slip ring with finger grasping regions thereon.

FIG. 9 shows an example of another example of the rescue device 80 wherein the rescue device comprises an annular member 81 with a cord 86 located therein. In this example the cord is secured to the ring by a loop so that the cord can rotate independently of the rescue ring. In order to facilitate throwing of the rescue device the rescue device includes an upper thumb slot 83 and a lower finger slot 83 for a user to place his or her fingers therein as the rescue ring is thrown to a victim in peril. In addition rescue ring 80 includes a nose 88 and an upward extension 87 to close off the open area for the reel. By closing off the open air the drag is reduce as the rescue ring 80 is thrown thereby enabling a rescue ring to be thrown further. That is, less of the vertical cross sectional area of the ring confronts the air flow as a blunt object.

Figure 10:
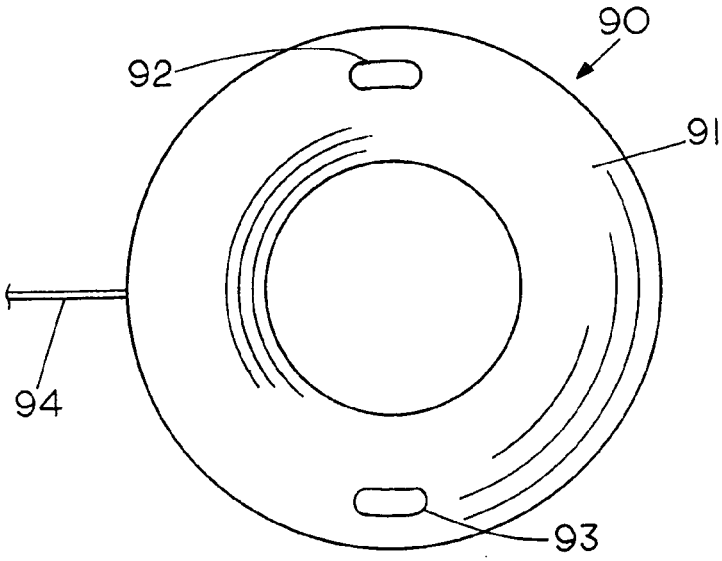
FIG. 10 is a top view of a rotateable rescue device with a finger-gripping region on the top surface of the rescue device.

FIG. 10 shows another example of a rescue ring 90 having a cord extending therefrom. In this embodiment the annular member includes a first griping region and a second gripping region that is secured to the top of the annular ring 71 by an adhesive. An example of such material is the Safety Walk manufactured and sold by the 3M company of St. Paul Minn.

Figure 10A:
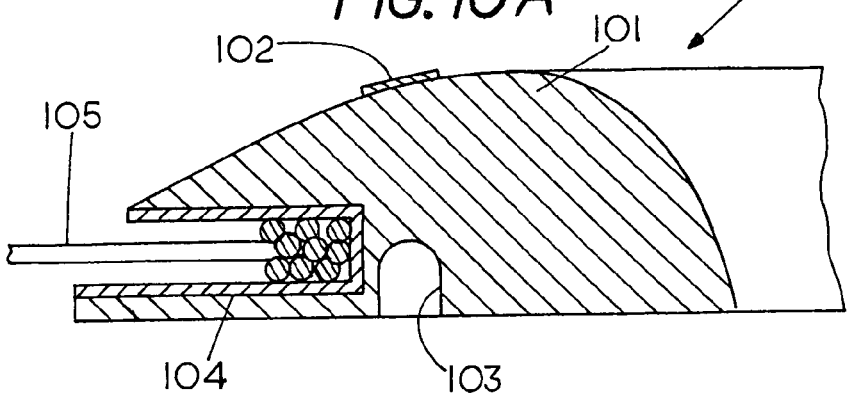
FIG. 10A is a cross sectional view of a rotateable rescue device that includes a slip ring with a finger grasping region on the top and bottom of the rescue device.

FIG. 10A shows a rescue device 100 wherein the rescue ring includes a gripping patch 102 on the top and an annular finger opening 103 to enable the user to better grasp ring 101 as it thrown to a victim in peril. A rotateable reel 104 with a rope 105 therein allows the reel 104 to rotate independently of the rescue ring thereby allowing the rescue ring to be thrown by either a left hand throw or a right hand throw.

Figure 11:
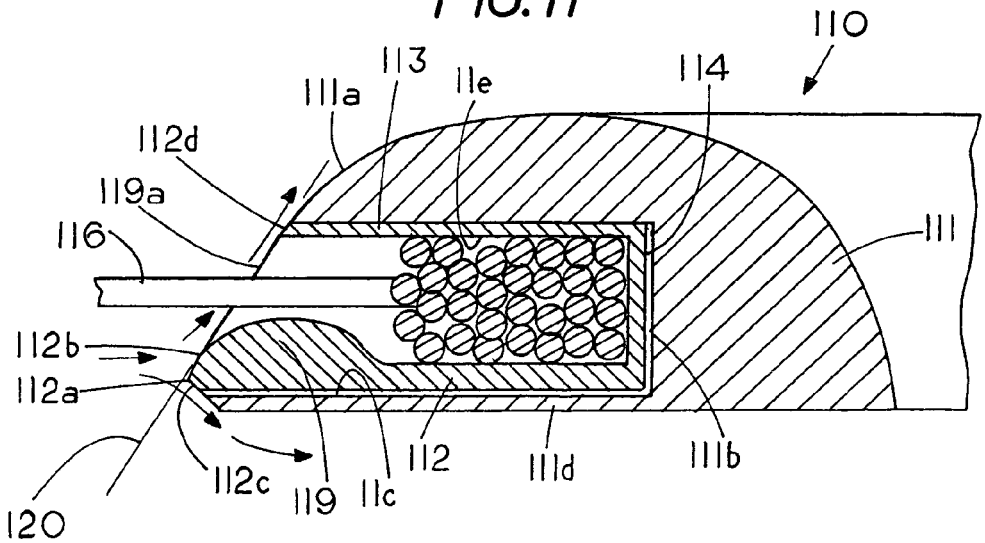
FIG. 11 is a cross sectional view of a rotateable rescue device that includes a slip ring with the split ring including a nose for diverting flow around the rescue device and an annular protrusion in the slip ring for limiting the aerodynamic drag on a thrown rescue device.

FIG. 11 shows a cross sectional view of a rescue ring 110 having an annular member 111 with a reel 112 located in an annular chamber in rescue ring 111 with the surface 111*d*, 111*b* and 111*e* forming bearing surfaces to permit reel 112 to rotate independently of the ring 111. In this example the reel extends radially outward to an annular air splitting nose 112*a* that directs air upward over the annular ring 111 or downward under the annular ring 111. That is a portion of the air flows downward along surface 112*c* and a further portion flows along surface 112*b* upward along surface 112*b* and 111*a*. The lower lip of reel 112 includes an upward extending member 119 to close off the opening for the cord 116 to thereby reduce the drag on the annular ring as the ring is thrown since the inlet for air into the reel 112 is restricted. FIG. 11 shows air splitting nose 112*b* with the height of the cord storage area in the slip ring greater than the height of the cord inlet 119*a* to the slip ring 119.

While the ambidextrous throwable rotateable rescue device may be used to rescue a victim in peril the rotateable rescue device can be used as an aid in docking a boat or in other applications where one needs to extend a rope between two locations when it is difficult or inconvenient to carry the rope from one location to another.

The invention also includes the method of delivering a throwable rescue device to a remote location comprising: winding a cord about a slip ring in either a clockwise or counter clockwise direction; throwing the throwable rotateable rescue in a rotary motion; allowing a slip ring to unwind at a rate of rotation independent of the rotation of the throwable rotateable rescue device; and pulling on the cord to unwind any cord remaining on the slip ring without rotating the throwable rotateable rescue device.

I claim:

1. A throwable rotateable rescue device comprising:

an annular member;

a slip ring rotationally mounted to said annular member;

a latch for preventing independent rotation of the slip ring with respect to the annular member; and a cord windable around said slip ring so that when the throwable rotateable rescue device is thrown in a rotational motion the slip ring can rotate independently of the rotation of the annular member as the cord unwinds from the throwable rotateable rescue device.

2. The throwable rotateable rescue device of claim 1 wherein the slip ring comprises a rigid slip ring concentrically positioned with respect to an annular bearing surface in said annular member.

3. The throwable rotateable rescue device of claim 1 wherein the slip ring comprise a cord loop with a portion of the cord loop extending circumferentially around an inner annular surface of said annular member to form an arm girth.

4. The throwable rotateable rescue device of claim 3 wherein the arm girth is releasable mounted to the inner annular surface through a radio activated latch mechanism so that a radio control signal can be used to control release of the arm girth.

5. The throwable rotateable rescue device of claim 1 wherein the latch comprises a radio controlled latch and the annular member is a flotation device.

6. The throwable rotateable rescue device of claim 5 wherein the throwable rotateable rescue device has a cross sectional shape of an air foil with a leading edge and a trailing edge wherein an interior circumferential surface of the flotation ring has the airfoil leading edge and the exterior circumferential surface of the flotation ring has the airfoil trailing edge and the slip ring is located internally of the annular member.

7. The throwable rotateable rescue device of claim 6 wherein the throwable rotateable rescue device comprises a floatation ring with a radio control device for a remote on-the-go controlling the release or locking of the slip ring and a remote on-the-go controlling the release of the arm girth.

8. The throwable rotateable rescue device of claim 1 wherein the slip ring includes a cord reel that is attached to an underside of the annular member and a latch mechanism for holding an arm girth in an open position for receiving a persons extremity.

9. The throwable rotateable rescue device of claim 8 wherein the cord reel includes an annular lip and the annular member includes an annular lip with the annular lip of the reel and the annular lip of the annular member forming annular slip surfaces to permit independent rotation of the annular member with respect the cord reel.

10. A throwable rotateable rescue device comprising:

a throwable member;

an annular slip ring support surface located within the throwable member;

a slip ring rotationally mounted on said annular slip ring support surface of with said slip ring located radially interior to said throwable member; and a cord windable around said slip ring with said cord having one end secured to said slip ring so that when the throwable rotateable rescue device is thrown in a rotational motion the slip ring can rotate independently of the rotation of the throwable member as the cord unwinds from the throwable rotateable rescue device.

11. The throwable rotateable rescue device of claim 10 wherein the slip ring comprises a rigid ring and the annular slip ring support surface comprises an annular bearing surface to permit rotation of the rigid ring with respect to the annular bearing surface.

12. The throwable rotateable rescue device of claim 10 wherein the slip ring includes a spring loaded latch to prevent rotation of the slip ring with respect to the throwable member.

13. The throwable rotateable rescue device of claim 10 wherein the slip ring includes an air splitting nose with the height of the cord storage area in the slip ring greater than the height of the cord inlet to the slip ring.

14. The throwable rotateable rescue device of claim 10 wherein the slip ring comprises an arm girth with a portion of the arm girth extending around an interior annular surface of the throwable member.

15. The throwable rotateable rescue device of claim 14 including a fastener for releasable holding the arm girth around the interior annular surface of the throwable member.

16. The method of delivering a throwable rescue device to a remote location comprising:

winding a cord about a slip ring supported on an annular support surface;

throwing a throwable rotateable rescue device in a rotary motion;

allowing a slip ring to unwind at a rate of rotation independent of the rotation of the throwable rotateable rescue device;

pulling on the cord to unwind any cord remaining on the slip ring without rotating the throwable rotateable rescue device.

17. The method of claim 16 including the step of cinching an arm girth about an extremity of a person by pulling on the rescue device to center the rope on the rescue devices so that the direction of pull on the rope is diagonally opposite of the person.

18. The method of claim 17 including the step of securing the arm girth to an interior annular surface of the throwable rotateable rescue device.

19. The method of claim 16 including the step of winding the cord in either a clockwise or counterclockwise wise direction on the slip ring and the throwing of the rotateable rescue devices with either a left hand throw or a right hand throw.

* * * * *